US005561254A

United States Patent [19]

Huffer

[11] Patent Number: 5,561,254

[45] Date of Patent: Oct. 1, 1996

[54] DEVICE FOR MODIFYING THE SOUND OF A DRUM

[75] Inventor: Scott Huffer, Lake City, Mich.

[73] Assignee: The Bohning Company, Ltd., Lake City, Mich.

[21] Appl. No.: 492,298

[22] Filed: Jun. 19, 1995

[51] Int. Cl.[6] ..... G10D 13/02

[52] U.S. Cl. ..... 84/411 M; 84/452 P

[58] Field of Search ..... 84/411 M, 452 R, 84/452 P

[56] References Cited

U.S. PATENT DOCUMENTS 4,325,280 4/1982 Hardy ..... 84/411 M
4,325,281 4/1982 Hardy ..... 84/411 M

*Primary Examiner*—Cassandra C. Spyrou
*Attorney, Agent, or Firm*—Douglas S. Bishop

[57] ABSTRACT

A device for modifying the sound of a drum or other percussion instrument comprises a sheet-like body of a soft, flexible polymer such as a gelled plastisol. The device includes a planar bottom surface which establishes a vacuum seal to a vibratable surface of the instrument.

13 Claims, 1 Drawing Sheet

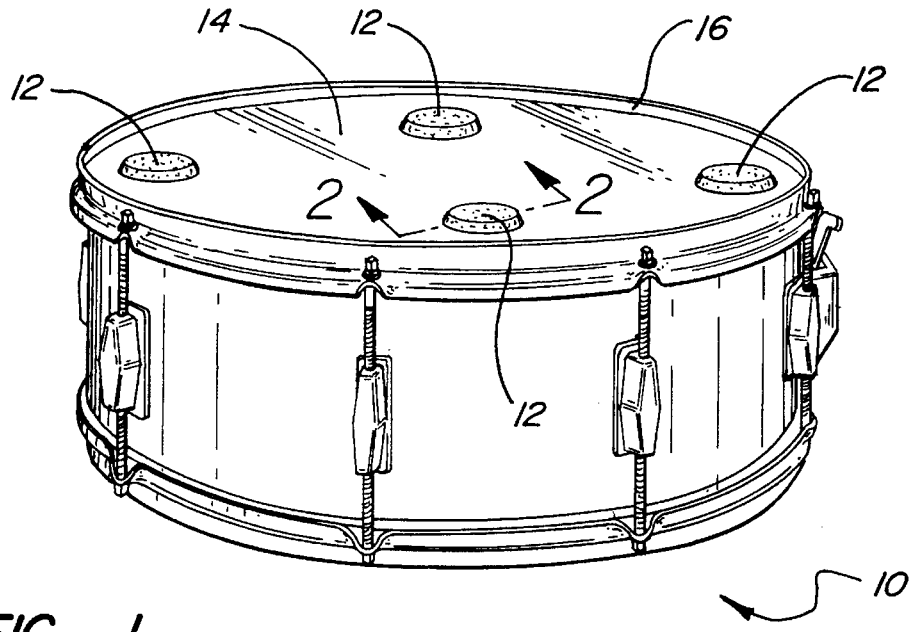
FIG - 1
FIG - 2
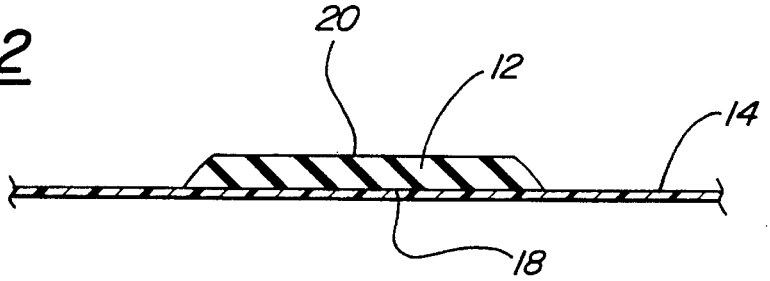
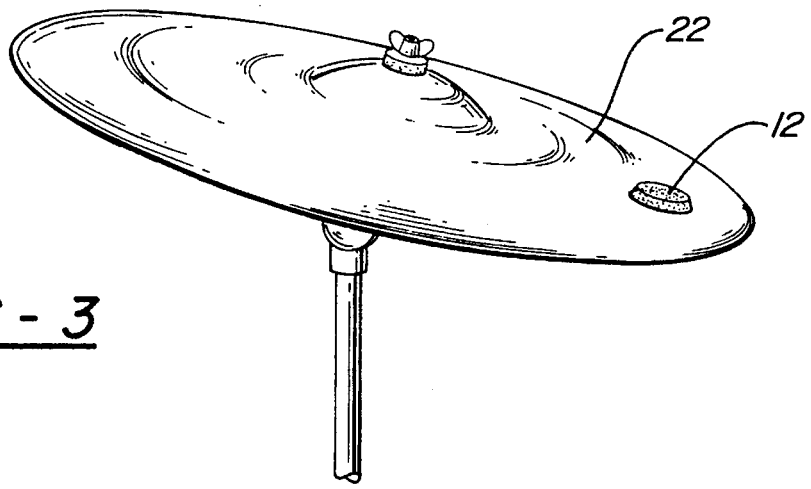
FIG - 3

DEVICE FOR MODIFYING THE SOUND OF A DRUM

FIELD OF THE INVENTION

The invention relates generally to musical instruments. More specifically, the invention relates to drums. Most specifically, the invention relates to a device which may be removably attached to the surface of a drum head, and in which muffles or otherwise modifies the sound of the drum.

BACKGROUND OF THE INVENTION

Drum heads have traditionally been made of natural materials such as leather or other animal derived membranes. Although the sound quality produced by natural membrane drums is very good, the membranes are expensive and their durability is poor. Furthermore, natural membranes are sensitive to moisture and other ambient atmospheric conditions; therefore, drums having natural membranes must frequently be re-tuned. As a result, synthetic materials are generally used for the fabrication of drum heads.

Synthetic drum heads are fabricated from sheets of polymeric material, such as polyethylene terepthalate and the like. Synthetic drum heads are very durable, relatively low in cost and environmentally stable; however, their sound quality is not as good as that of natural membrane drums. This is primarily a result of the fact that the synthetic material is relatively rigid and tends to propagate and sustain unwanted overtones. These undesirable vibrations are usually referred to as "ringing". The problem of ringing is further exacerbated by recording equipment and other such electronic sound systems.

A number of approaches have been implemented in the prior art to lessen ringing and restore a natural sound to drum sets. In some instances, drummers place a body of cloth or other similar material against a drum to deaden the drum head action. This approach is only partially successful and tends to limit the active surface of the drum which can be played. Another approach is disclosed in U.S. Pat. No. 4,308,782 which describes a drum head fabricated from a laminated composite of a rigid plastic sheet and a synthetic fabric. Yet another approach is shown in U.S. Pat. No. 4,244,266 which discloses a foam rubber ring which is adhesively attached to the inner surface of a drum head for deadening vibration. A similar approach is shown in U.S. Pat. No. 4,325,280 which discloses a series of foam rubber blocks which are adhesively attached to the interior surface of a drum head. The devices of the '266 and '280 patents require disassembly of the drum for attachment. Furthermore, the adhesive attachment, and interior location, of the members precludes their easy removal and/or repositioning.

Accordingly, it will be appreciated that there is a need for a device which can be utilized to deaden or muffle ringing associated with synthetic drum heads. The device should be easily attached and removed from the drum and should not unduly interfere with playing of the drum, or the aesthetic appeal of the drum set.

The present invention provides a device which effectively muffles drum head ringing. The device may be quickly attached and detached from the drum head, without disassembly of the drum. The device does not affect the tuning of the drum, and may be configured to actually enhance the appearance of the drum set. The device of the present invention may also be used in connection with other percussion instruments such as cymbals, and may be utilized as a mute to decrease the volume of a drum. These and other advantages of the present invention will be readily apparent from the drawings, discussion and description which follow.

BRIEF DESCRIPTION OF THE INVENTION

There is disclosed herein a device for muffling or otherwise modifying the sound of a drum, cymbal or other such percussion instrument. The device comprises a sheet-like flexible body of a polymeric material which is configured to engage a vibratable surface of drum head or cymbal in an airtight relationship so as to establish a vacuum seal therewith. The seal serves to retain the body of polymeric material on the drum or cymbal, and the flexible polymeric material effectively absorbs and dampens vibrations. The polymeric material is preferably a gel-like body of cured plastisol, and preferably has a durometer rating in the range of 15–60. The polymeric body may be colored. In particular embodiments the device may be configured as a disk, and a number of relatively small diameter disks may be appropriately located about the perimeter of the drum. In other embodiments, the device may be a relatively large diameter disk which covers a major portion of the playing surface of the drum. In this embodiment, the polymeric body is struck directly and functions to mute the volume of the drum. In other embodiments, the device may be a ring-like member.

BRIEF DESCRIPTION OF THE DRAWINGS

FIG. 1 is a perspective view of a drum showing a number of sound deadening devices of the present invention affixed thereto.

FIG. 2 is a cross sectional view of one embodiment of the modifying device structured in accord with the principles of the present invention shown as attached to a drum head; and FIG. 3 is a perspective view of a cymbal having a sound modifying device of the present invention attached thereto.

DETAILED DESCRIPTION OF THE INVENTION

The present invention comprises a device which may be removably attached to a drum head, cymbal or other such vibrating percussion instrument. The device is fabricated from a body of sheet-like, flexible polymeric material and is configured to adhere to the instrument by means of a vacuum seal without the use of any adhesive. Referring now to FIG. 1, there is shown a drum 10 having a number of sound modifying devices 12 structured in accord with the present invention, adhered to the drum head 14 thereof. It will be noted that in the illustrations, four devices 12 are shown affixed to the drum head at relatively equally spaced locations thereupon, spaced a short distance away from the rim 16 of the drum 10.

It is to be understood that within the scope of the present invention, a larger or smaller number of sound modifying devices may be employed, and they may be otherwise positioned. The number and placement of the devices will depend upon the size of the drum, the size of the devices, and the degree of sound modification required. In most instances, between one and four devices will be employed, and they are typically placed within three inches of the rim of the drum.

Referring now to FIG. 2, there is shown a cross sectional view of one of the devices 12 as adhered to a drum head 14. The device 12 is configured as a disk which has a thickness which is less than its diameter. Within the context of the present disclosure, the device 12 is described as being "sheet-like" and this refers to the fact that in general its thickness, whatever its shape, will be less than its major width dimension. The device is fabricated from a flexible polymeric body, and its sheet-like nature assures that it will conform and adhere readily to a surface. The device 12 includes a bottom surface 18 which is relatively planar. The device of the present invention is very flexible; therefore, the bottom surface can readily change curvature. In the context of this disclosure the term relatively planar bottom surface is meant to define a surface which is smooth and free of projections which would interfere with the formation of a vacuum seal. The top surface 20 of the device 12 is also shown as being planar in the FIG. 2 embodiment; although, it is to be understood that within the context of the present invention, this surface may be otherwise configured. In some embodiments, decorative shapes, textures and the like may be provided on the upper surface 20. The planar configuration of the bottom surface 18, together with the flexible nature of the device 12 enables the bottom surface 18 to conformally engage the drum head 14 in an airtight relationship. In this manner, the device 12 establishes a vacuum seal with the drum head so that atmospheric pressure adheres the device 12 onto the drum head 14 so that it will not be displaced by vibration.

The device 12 is preferably fabricated from a very flexible, very soft, polymeric material. One particularly preferred material comprises a polymeric material having a durometer rating in the range of 15–60, and preferably in the range of 20–50. The most particularly preferred material comprises a gel-like cured plastisol formulation. As is known in the art, a plastisol comprises a fine dispersion of a particulate, thermoplastic polymer in a material which is a plasticizer for that polymer. Plastisol compositions are initially of a relatively fluid nature; however, once they are heated to an elevated temperature, the thermoplastic material softens, fuses and is penetrated by the plasticizer so as to form a gel-like matrix of highly plasticized polymer. Depending on the particular resins employed, and the concentration of plasticizer, a variety of materials may be produced having textures ranging from a relatively leathery or rubbery texture to a gelatinous texture.

The plastisol materials most preferred for the practice of the present invention are those having a relatively soft texture. The devices fabricated from such material easily conform and adhere to the surface of the drum. In addition, the high degree of plasticizer present in the material provides for a very slow bleed of plasticizer to the surface of the device, and the presence of a thin film of the plasticizer further enhances the vacuum seal of the device to the drum held.

Plastisol materials may be prepared from a wide variety of thermoplastics together with appropriate plasticizers. One particularly preferred plastisol material is based upon polyvinyl chloride resin and a dioctyl tetra pthalate plasticizer having approximately 15–60% by weight of polyvinyl chloride resin and 40–85% by weight of dioctyl tetra pthalate. This mixture is placed into a mold and heated to approximately 375° F. for ten minutes to produce a cured plastisol polymer. Other ingredients may be added to the plastisol mixture. For example, coloring agents, reflective metal flakes and the like may be added to the plastisol mixture to produce an aesthetically pleasing effect. In some instances, cross linking resins such as epoxy resins and the like may be added to the plastisol mixture to enhance the rigidity of the finished item. Preservatives, stabilizers and the like may also be added, as is known in the art.

One particularly preferred composition comprises, by weight: 17.9% polyvinyl chloride resin; 80.4% dioctyl tetra pthalate; 0.009% epoxidized soybean oil; 009% tin stabilizers, and 1.69% uvand heat stabilizers. This material results in a cured plastisol having a durometer of approximately 20–30. This relatively soft material is particularly well suited for fabricating sound deadening devices of the type illustrated in FIG. 1, which are attached at the periphery of the playing surface of the instrument.

In some instances, the device of the present invention may be fabricated as a relatively large diameter device which is adhered directly on the portion of the instrument which is struck. This device then functions to mute the instrument. For example, in one application for drums, the device may be fabricated as a disk of approximately 9–16 inches in diameter configured to be placed directly in the center of the drum to decrease the volume of its sounds. In those instances where the device is relatively large disk, the center may be cut out. For example, a 16 inch diameter mute may have a 6–8 inch opening in the center. The drummer may then strike either the mute or the drum head.

It is generally desirable that the muting device be made of a slightly harder material and a particularly preferred plastisol composition therefore comprises a composition generally similar to that above, but including approximately 40–60% PVC and 50–60% dioctyl tetra pthalate. When cured, this material has a durometer rating of approximately 40–50.

Although the present invention has generally been described with reference to drums, it will be understood that it may be utilized in conjunction with cymbals, or any other such percussion instrument. FIG. 3 illustrates a cymbal 22 having device 12 of the present invention attached thereto. The device 12 may be disposed outside of the playing area of the cymbal, and may function to muffle and/or modify sound of the cymbal. Alternatively, the device 12 may be placed in a location where the cymbal is struck and thereby function to further mute the sound of the cymbal.

While the present invention has been described primarily with reference to plastisol based materials, it is to be understood that these merely represent one particularly preferred class of materials for the practice of the present invention. The invention may be practiced in combination with flexible polymers of other types, provided those polymers are capable of effecting a vacuum type seal with an underlying surface. Such other polymers comprise synthetic elastomers, silicones, gum rubbers, gels and the like. While the invention has been described with reference to disk shaped members, it will be readily appreciated that other configurations of the device may be readily implemented. For example, ring shaped devices, square, rectangular or elongated devices as well as oval or polygonal devices may be employed. In view of the foregoing, it will be appreciated that numerous modifications and variations of the present invention may be implemented in accord with the teaching herein, and the foregoing drawings, discussion and description are merely meant to illustrate particular embodiments of the invention and are not meant to be limitations upon the practice thereof. It is the following claims, including all equivalents, which define the scope of the invention.

I claim:

1. A device for modifying the sund of a percussion instrument, said device comprising:

a sheet-like flexible body of a cured plastisol material having a durometer rating inthe range of 15–60, said body having a relatively planar bottom surface operable to confomably engage a vibratable surface of a percussion instrument in an airtight relationship so as to establish a vacuum seal therewith, whereby said body of polymeric material is emovably retained upon said instument by atmsopheric pressure so that it will not be displaced by vibration of said vibratable surface.

2. A device as in claim 1, wherein said plastisol comprises, by weight, 15–60% of a thermoplastic resin and 40–85% of a plasticizer for said resin.

3. A device as in claim 2, wherein said plastisol further includes a coloring agent.

4. A device as in claim 2, wherein said plastisol further includes a cross linking resin.

5. A device as in claim 2 wherein said thermoplastic resin comprises a vinyl resin.

6. A device as in claim 5, wherein said thermoplastic resin comprises polyvinyl chloride.

7. A device as in claim 2, wherein said plasticizer comprises a pthalate ester.

8. A device as in claim 7, wherein said pthalate ester is dioctyl tetra pthalate.

9. A device as in claim 1, wherein said body of plastisol material is configured as a disk having a thickness dimension which is less than a diameter thereof.

10. A device as in claim 1, wherein said device is configured to engage a drum head.

11. A device for modifying the sound of a drum, said device comprising:

a sheet-like, flexible body of a cured plastisol material comprising, by weight, 15–60% of a thermoplastic resin and 40–85% of a plasticizer for said resin, said material having a durometer rating in the range of 15–60; said body having a thickness which is less than its major width dimension, and a relatively planar bottom surface operable to conformably engage a surface of a drum head in an airtight seal therewith, whereby said body of polymeric material is retained upon said drum head by atmospheric pressure so that it will not be displaced by vibration of said drumhead.

12. A device as in claim 11, wherein said cured plastisol has a durometer rating in the range of 20–30.

13. A device as in claim 11, wherein said cured plastisol has a durometer rating in the range of 40–50.

* * * * *